US005963563A

United States Patent [19]

Tomikura et al.

[11] Patent Number: 5,963,563

[45] Date of Patent: Oct. 5, 1999

[54] FM MULTIPLEX INFORMATION RECEIVING APPARATUS

[75] Inventors: Yoshihiro Tomikura, Neyagawa; Noriaki Furuta, Otsu; Masayoshi Yano, Hirakata, all of Japan

[73] Assignee: Matsushita Electric Industrial Co., Ltd., Osaka-fu, Japan

[21] Appl. No.: 08/842,141

[22] Filed: Apr. 23, 1997

[30] Foreign Application Priority Data

Apr. 26, 1996 [JP] Japan ..... 8-106723

[51] Int. Cl.[6] ..... H04H 1/04

[52] U.S. Cl. ..... 370/486; 375/316; 455/186.1

[58] Field of Search ..... 370/480, 483, 370/486, 487; 455/186.1, 185.1, 45; 375/260, 316; 340/825.44

[56] References Cited

U.S. PATENT DOCUMENTS 5,497,372 3/1996 Nankoh et al. ..... 370/69.1
5,581,576 12/1996 Lanzetta et al. ..... 455/186.1
5,870,682 2/1999 Miwa et al. ..... 455/45
5,890,053 3/1999 Hino et al. ..... 455/186.1
5,898,910 4/1999 Miyake et al. ..... 455/186.1

*Primary Examiner*—Michael Horabik
*Assistant Examiner*—Binyam Tadesse
*Attorney, Agent, or Firm*—Akin, Gump, Strauss, Hauer & Feld, L.L.P.

[57] ABSTRACT

The present invention provides an FM multiplex information receiving apparatus capable of reducing a required time for indicating a received program to a necessary minimum time and capable of executing update process for a update program. An FM multiplex information receiving apparatus is configured so as to operate as follows. The apparatus stores a received program into the memory in case that a program number which is the same as the received program is present in memory and these update code differ. The apparatus deletes the program-related information at power off or on. The apparatus retains the non-program related information in the memory until a lapse of a certain time after power off.

9 Claims, 6 Drawing Sheets

FM MULTIPLEX INFORMATION RECEIVING APPARATUS

BACKGROUND OF THE INVENTION

The present invention relates to memory control of an FM multiplex information receiving apparatus.

In a conventional FM multiplex information receiving apparatus which receives FM broadcast waves including character/image information and so on superimposed thereon and indicates the received FM multiplex information, the received FM multiplex information is temporarily stored in a memory thereof so as to ensure smooth indication of the received FM multiplex information and is indicated. Furthermore, when the power is turned off, all FM multiplex information stored in the memory is deleted in order to make power-off operation less complicated.

In such a conventional FM multiplex information receiving apparatus, all the information stored in the memory is deleted when the power is turned off. Therefore, it is necessary to re-store the information into the memory when the power is turned on, thereby taking a spare time till the information is indicated.

In other conventional FM multiplex information receiving apparatus, the FM multiplex information stored in a memory is not deleted when the power is turned off but is retained in the memory even after the power is turned off. Such a conventional FM multiplex information receiving apparatus has a shortcoming that in case where an update code of a program now being broadcast completes one round when the power is turned on, the update code of the program now being broadcast agrees with a update code of the program having been stored in the memory. It is therefore impossible to detect whether the information of the program being broadcast has been updated or not. Sometimes this causes the problem of being unable to update the old information having been stored in the memory.

BRIEF SUMMARY OF THE INVENTION

An object of the present invention is to provide an FM multiplex information receiving apparatus capable of reducing a required time for indicating a received program to a necessary minimum time and capable of assurely executing update process for a updated program.

An FM multiplex information receiving apparatus in accordance with the present invention comprises, means for receiving FM multiplex information including related-program information which is interlocked with audio program being broadcast and non-program related information which is not interlocked with audio program being broadcast, means for, during reception of the FM multiplex information, storing into memory FM multiplex information that is updated at predetermined interval together with update code, comparing the update code of FM multiplex information on receiving with the update code of FM multiplex information having been stored in the memory, and updating the stored FM multiplex information to FM multiplex information being received in case there is an inconsistence as the result of comparison, means for retaining the non-program related information in the memory for predetermined time length after power off and deleting the program-related information at power off or power on, and means for indicating the non-program related information stored in the memory when the power is turned on again within the predetermined time length after the power is turned off.

With the above-mentioned configuration, the information having been stored in the memory is updated when the received information has been updated during power off or when the received information is updated during reception. In addition, the program-related information is deleted from the memory when the power is turned off or on. The non-program related information is retained in the memory for the predetermined time length after the power is turned off and then deleted from the memory after the predetermined time length. Therefore, the required time for indicating the received information can be reduced to a necessary minimum time. Moreover even when the non-program related information has been updated while the power is off, the before-update information having been stored in the memory is assurely replaced with the update information. Therefore the before-update information is presented from remaining in the memory.

An FM multiplex information receiving apparatus in accordance with another aspect of the present invention comprises, means for receiving FM multiplex information including related-program information which is interlocked with audio program being broadcast and non-program related information which is not interlocked with audio program being broadcast, means for, during reception of the FM multiplex information, storing into memory FM multiplex information that is updated at predetermined interval together with update code, comparing the update code of FM multiplex information on receiving with the update code of FM multiplex information having been stored in the memory, and updating the stored FM multiplex information to FM multiplex information being received in case there is an inconsistence as the result of comparison, and means for determining whether the memory has full space area for said FM multiplex information when the FM multiplex information is stored in the memory, selecting program number of program to be deleted from FM multiplex information stored in the memory in accordance with a predetermined method in case the memory does not have said full space area, deleting the information of the selected program, and storing newly received FM multiple information.

With the above-mentioned configuration, the information stored in the memory is updated when the received information has been updated during power off or when the received information is updated during reception. Furthermore, whether the memory has full space area for the FM multiplex information is determined when storing the received information into the memory. In case the memory does not have full space area for the FM multiplex information, the information of the program corresponding to a program number selected by the predetermined method is deleted from the memory. After this deletion, the received information is stored into the memory. Therefore, the required time for indicating the received information can be reduced to a necessary minimum time. In addition the memory can be effectively used when received information is stored into the memory.

An FM multiplex information receiving apparatus in accordance with a still other aspect of the present invention comprises, receiving means for receiving FM multiplex information including related-program information which is interlocked with audio program being broadcast and non-program related information which is not interlocked with audio program being broadcast, FM multiplex information decoding means for decoding FM multiplex information received by the receiving means, data conversion means for converting information decoded by the FM multiplex information decoding means, memory means for storing data converted by the data conversion means, program/page comparison means for comparing program number of received program and page number of each page of the received program with program number and page number of each page of program having been stored in the memory means, respectively, when the data is stored in the memory means, first memory control means for controlling to store the data converted by the data conversion means into the memory means with the size of the whole program in case the data having the same program number has not yet been stored in the memory means or with the size of the whole page in case data having the same page number has not been stored in the memory means as the result of comparison by the program/page comparison means, update code comparison means for comparing update code of the received program or update code of each page of the received program with update code of program having the same program number or update code of page having the same page number having been stored in the memory means, respectively, in case data having the same program number or the same page number has been stored in the memory means as the result of comparison by the program/page comparison means, second memory control means for controlling to execute update process with the size of the whole program in case the update code of the received program differs from the update code of program having the same program number or with the size of the page in case the update code of the page of the received program differs from the update code of page having the same page number as the result of comparison by the update code comparison means, third memory control means for controlling to retain the non-program related information in the memory means for preset time length after power off, fourth memory control means for controlling to delete the non-program related information from the memory means after the preset time length, fifth memory control means for controlling to delete the program-related information at least at power off and power on, and indication means for indicating the non-program related information in the memory means at power on.

By using the FM multiplex information receiving apparatus having the above-mentioned configuration, the required time for indicating the received information can be reduced to a necessary minimum time. Moreover even when the non-program related information has been updated while the power is off, the before-update information having been stored in the memory means is assurely replaced with the update information. Therefore the before-update information is presented from remaining in the memory means.

An FM multiplex information receiving apparatus in accordance with a still other aspect of the present invention comprises, receiving means for receiving FM multiplex information including related-program information which is interlocked with audio program being broadcast and non-program related information which is not interlocked with audio program being broadcast, FM multiplex information decoding means for decoding FM multiplex information received by the receiving means, data conversion means for converting information decoded by the FM multiplex information decoding means, memory means for storing data converted by the data conversion means, program/page comparison means for comparing program number of received program and page number of each page of the received program with program number and page number of each page of program having been stored in the memory means, respectively, when the data is stored in the memory means, first memory control means for controlling to store the data converted by the data conversion means into the memory means with the size of the whole program in case the data having the same program number has not yet been stored in the memory means or with the size of the whole page in case data having the same page number has not been stored in the memory means as the result of comparison by the program/page comparison means, update code comparison means for comparing update code of the received program or update code of each page of the received program with update code of program having the same program number or update code of page having the same page number having been stored in the memory means, respectively, in case data having the same program number or the same page number has been stored in the memory means as the result of comparison by the program/page comparison means, second memory control means for controlling to execute update process with the size of the whole program in case the update code of the received program differs from the update code of program having the same program number or with the size of the page in case the update code of the page of the received program differs from the update code of page having the same page number as the result of comparison by the update code comparison means, sixth memory control means for determining whether the memory means has full space area for the FM multiplex information, program selection means for selecting data of program to be deleted from the memory means in case the memory means does not have the full space area as the result of determination by the sixth memory control means, and memory clear control means for controlling to delete the data of program selected by the program selection means from the memory means.

By using the FM multiplex information receiving apparatus having the above-mentioned configuration, the required time for indicating the received information can be reduced to a necessary minimum time. In addition the memory means can thus be effectively used when received information is stored into the memory means.

BRIEF DESCRIPTION OF THE SEVERAL VIEWS OF THE INVENTION

DETAILED DESCRIPTION OF THE INVENTION

Preferred embodiments in accordance with the present invention will be elucidated below in detail referring to FIGS. 1 to 6.

[Embodiment 1]

Figure 2:
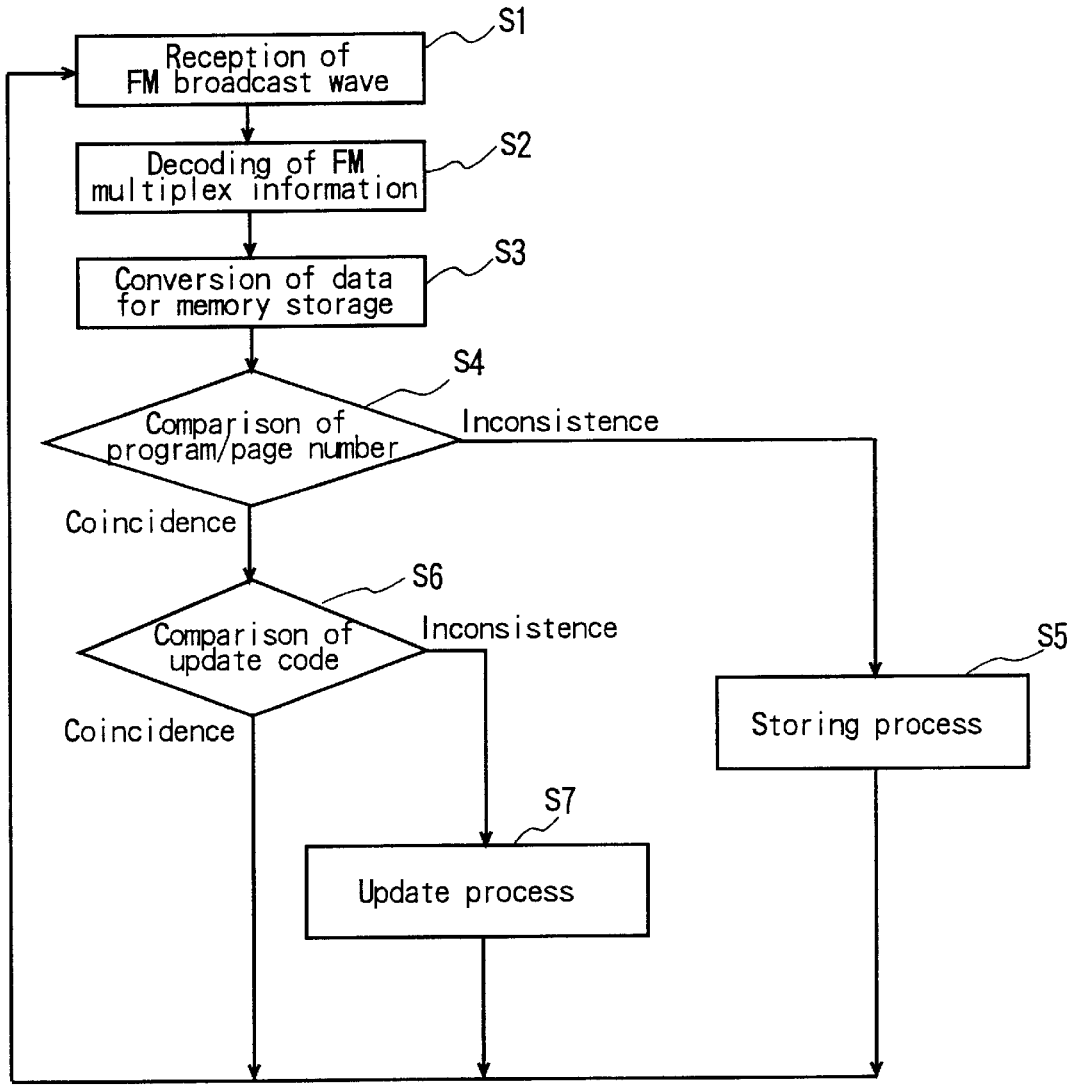
FIG. 2 is a flow chart showing the reception process of the FM multiplex information receiving apparatus shown in FIG. 1.
Figure 3:
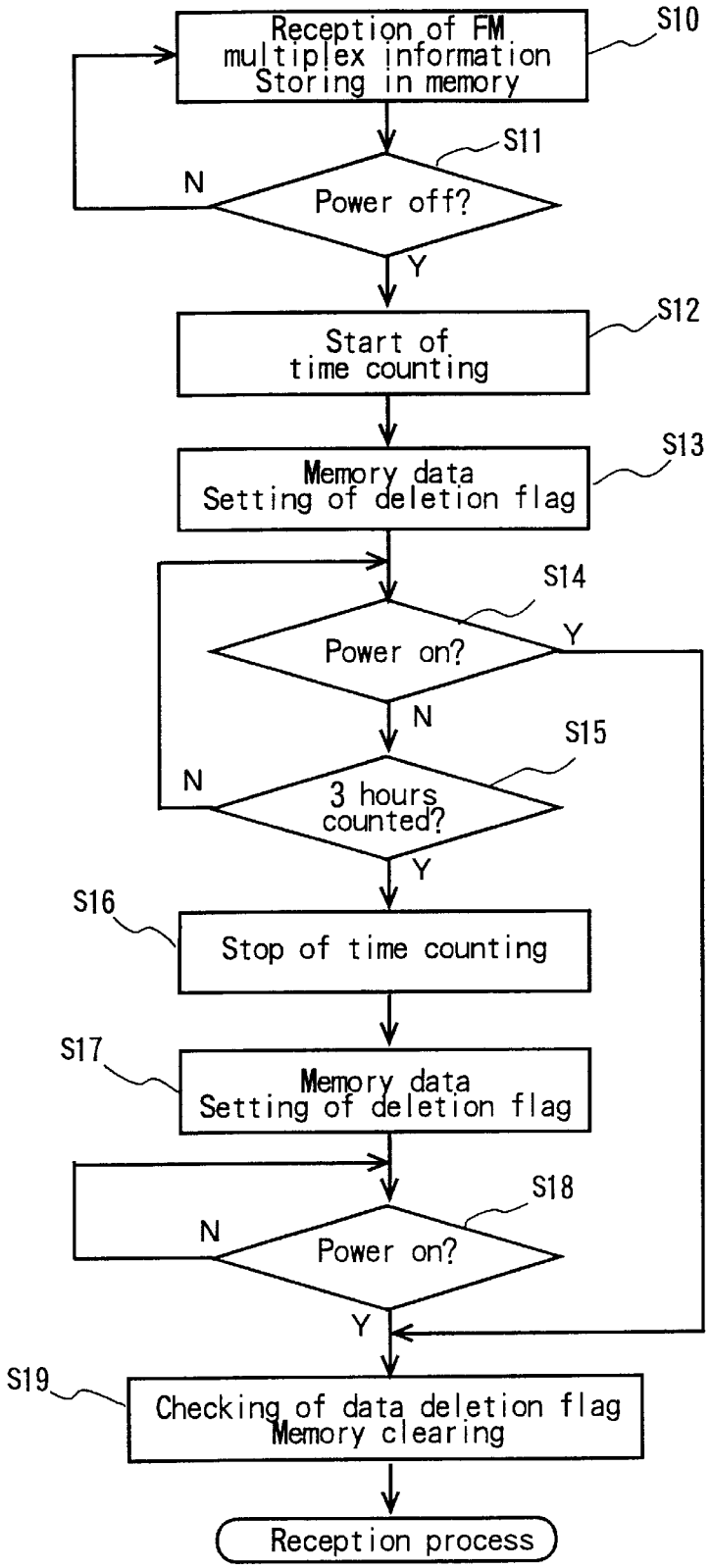
FIG. 3 is a flow chart showing the memory control process of the FM multiplex information receiving apparatus shown in FIG. 1.

An FM multiplex information receiving apparatus in accordance with the Embodiment 1 of the present invention is elucidated below in detail referring to FIGS. 1 to 3.

Figure 1:
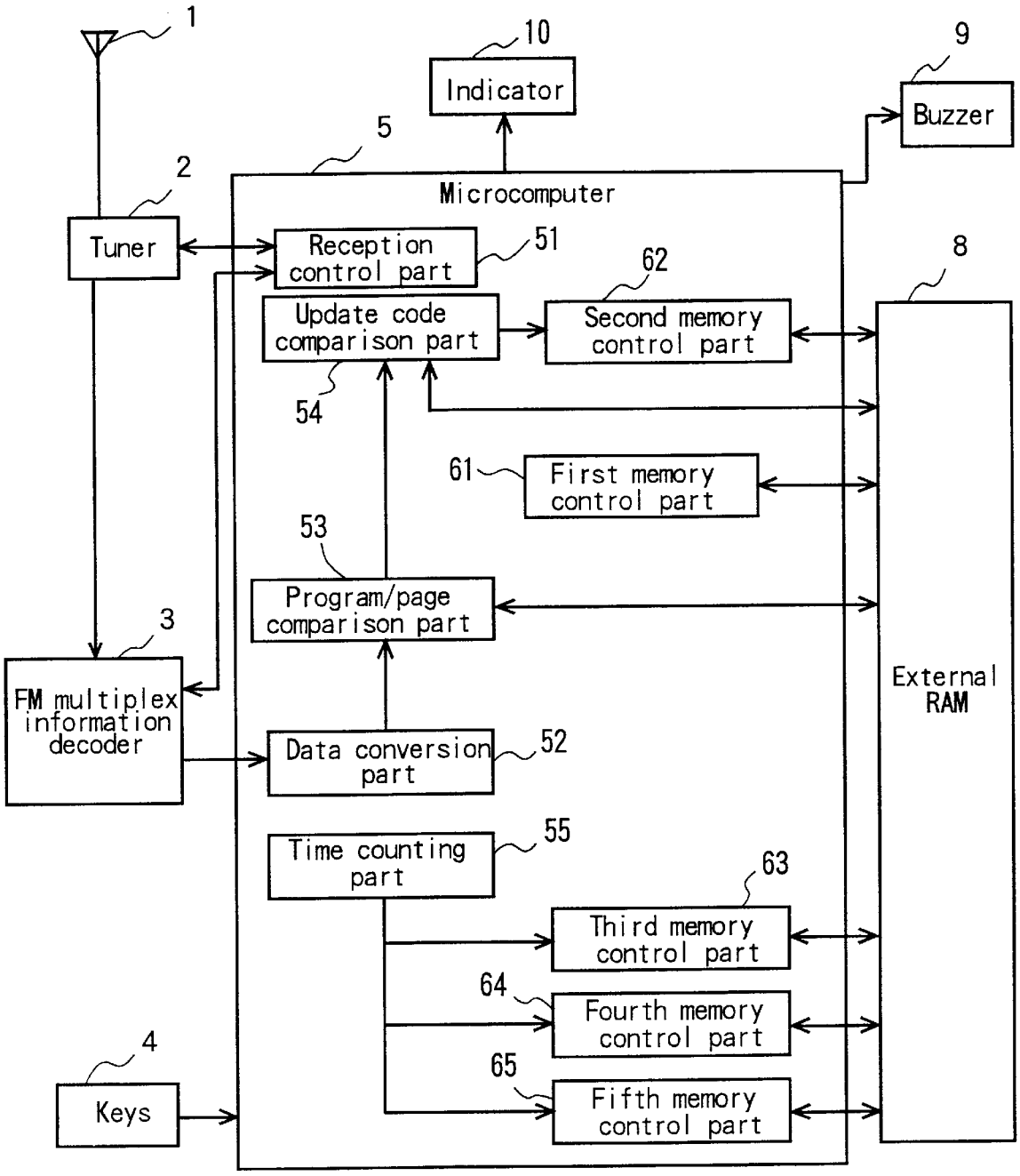
FIG. 1 is a circuit block diagram showing the configuration of an FM multiplex information receiving apparatus in accordance with the present invention.

FIG. 1 shows the FM multiplex information receiving apparatus in accordance with the Embodiment 1. The FM multiplex information receiving apparatus comprises an FM broadcast receiving antenna 1, an FM broadcast receiving tuner 2, an FM multiplex information decoder 3, a keys 4, a microcomputer 5, an external RAM 8, a buzzer 9 and an indicator 10.

The FM broadcast receiving antenna 1 receives FM broadcast waves including character/image information and so on superimposed thereon. The FM broadcast receiving tuner 2 is connected to the FM broadcast receiving antenna 1 and selects desired received frequency of FM broadcast waves. The FM multiplex information decoder 3 is connected to the output-terminal of the FM broadcast receiving tuner 2 and decodes FM multiplex information superimposed on the FM broadcast waves from the FM broadcast receiving tuner 2. The microcomputer 5 controls the FM broadcast receiving tuner 2 and the FM multiplex information decoder 3, and moreover controls to store data into the external RAM 8 and deletes data from the external RAM 8. The internal configuration of the microcomputer 5 is detailed later. The keys 4 is connected to the microcomputer 5 and inputs power on/off instruction. The external RAM 8 is connected to the microcomputer 5 and stores data. The buzzer 9 is connected to the microcomputer 5 and generates a beep when FM multiplex information is updated on receiving. The indicator 10 is connected to the microcomputer 5 and displays the received information and also displays an update message when FM multiplex information is updated on receiving.

An ordinary FM multiplex information program comprises a program control data and one or more page data. The program control data has a program data header and a group of data unit. Each page data has a page data header and a group of data unit. The program data header includes a program number and an update code. The page data header includes a program number, a page number and an update code. There are the following two ways to update the data of the FM multiplex information having been stored in the external RAM 8. The first way is to update the data with the size of the whole program. In this case, the update code of the program data header is updated and the data of all page data are updated. In the second way, the data is updated with the size of the whole page. In this second way, the update code of the program data header is not updated, but the update code of the page data header is updated and the data of the page data is also updated. The update code is a two-bit code. When the update code is updated four times, the update code completes one round.

The FM multiplex information comprises a program-related information which is interlocked with audio program and a non-program related information which is not interlocked with audio program. As the program-related information, there are, for instance, titles of musical compositions and names of artists. As the non-program related information, there are, for instance, news & sports information, weather information, traffic information and entertainment information.

The microcomputer 5 is elucidated below in detail.

The microcomputer 5 comprises a reception control part 51, a data conversion part 52, a program/page comparison part 53, an update code comparison part 54, a time counting part 55, a first memory control part 61, a second memory control part 62, a third memory control part 63, a fourth memory control part 64 and a fifth memory control part 65.

The reception control part 51 is for controlling the FM broadcast receiving tuner 2 and the FM multiplex information decoder 3. The data conversion part 52 is for converting information decoded by the FM multiplex information decoder 3 into the data to be stored into the external RAM 8. The program/page comparison part 53 is for comparing the program number of the program control data and the page number of each page data of the data converted by the data conversion part 52, respectively, with the program number of the program control data and the page number of each page data of the data having been stored in the external RAM 8. The update code comparison part 54 is for comparing the update code of the program data header of the program control data and the update code of the page data header of each page data of data converted by the data conversion part 52, respectively, with the update code of the program data header of the program control data and the update code of the page data header of each page data of data having been stored in the external RAM 8. The time counting part 55 is for counting a time elapsed after the power is turned off. The first memory control part 61 is for controlling to store the data converted by the data conversion part 52 into the external RAM 8. The second memory control part 62 is for controlling to execute update process which replaces the data converted by the data conversion part 52 with the data having the same program number or the same page number and moreover having a difference update code. The third memory control part 63 is for controlling to retain the non-program related information stored in the external RAM 8 for three hours after the power is turned off. The fourth memory control part 64 is for controlling to set a deletion flag for the non-program related information three hours after the power is turned off and deleting the non-program related information having the deletion flag from the external RAM 8 when the power is turned on. The fifth memory control part 65 is controlling to set a deletion flag for the program-related information when the power is turned off and deleting the program-related information having the deletion flag from the external RAM 8 when the power is turned on.

[Reception Process of FM Multiplex Information]

The reception process of the FM multiplex information receiving apparatus is elucidated below in detail referring to the flow chart shown in FIG. 2.

The FM broadcast receiving antenna 1 receives FM broadcast waves. The reception control part 51 controls the FM broadcast receiving tuner 2 so that the reception frequencies of the FM broadcast receiving tuner 2 is selected (step S1). The reception control part 51 controls the FM multiplex information decoder 3 so that the FM multiplex information decoder 3 decodes the FM multiplex information superimposed on the FM broadcast waves (step S2). The data conversion part 52 converts the decoded information into data for storing into the external RAM 8 (step S3). The program/page comparison part 53 compares the program number of the program control data and the page number of each page data of the converted data with the program number of the program control data and the page number of each page data of the data having been stored in the external RAM 8, respectively. In case where the comparison result in that the data having the same program number of the program control data or the same page number of each page data has not yet been stored in the external RAM 8, the program/page comparison part 53 determines that new program or new page information which is not stored in the external RAM 8 is received. Then the control sequence proceeds to step S5. On the contrary, in case where the comparison result that the data having the same program number of the program control data or the same page number of each page data of the converted data has been stored in the external RAM 8, the control sequence proceeds to step S6 (step S4). The first memory control part 61 controls to store the data converted by the data conversion part 52 into the external RAM 8 (step S5). The update code comparison part 54 compares the update code of the program data header of the program control data and the update code of the page data header of each page data of the converted data, respectively, with the update code of the program data header of the program control data and the update code of the page data header of each page data of the data having been stored in the external RAM 8. In case the data having the same update code of the program data header of the program control data and the same update code of the page data header of each page data has been stored in the external RAM 8, the data that is the same as the converted data has already been stored in the external RAM 8, thereby the converted data is not stored into the external RAM 8. On the contrary, in case the data having a difference update code of the program data header of the program control data or a difference update code of the page data header of each page data has been stored in the external RAM 8, the control sequence proceeds to step S7 (step S6). In case the data having the same update code of the program data header of the program control data has not been stored in the external RAM 8, the second memory control part 62 controls to store the converted data into the external RAM 8. In case the data having the same update code of the page data header of the page data has not been stored in the external RAM 8, the second memory control part 62 controls to store the converted data of the page data having the difference update code into the external RAM 8 (step S7).

The received FM multiplex information can be stored efficiently into the external RAM 8 by repeating the above-mentioned steps.

In the update process at step S7, a beep may be issued from the buzzer 9 and a update message may be displays on the display screen of the indicator 10, so as to notify that the received information has been changed.

[Memory Control Process]

The memory control process of the FM multiplex information receiving apparatus is elucidated below in detail referring to the flow chart shown in FIG. 3.

Let us assume that, on receiving the FM multiplex information and storing the data of the received information into the RAM 8 (step S10), power off instruction is input by the keys 4 (step S11). Then the time counting part 55 begins to count the length of time elapsed after the power is turned off, and the third memory control part 63 controls to retain the non-program related information in the external RAM 8 until a lapse of three hours after the power is turned off (step S12). The fifth memory control part 65 sets a deletion flag for the program-related information stored in the external RAM 8 (step S13). When power on instruction is input by the keys 4 within three hours, the fifth memory control part confirms the deletion flag and deletes the program-related information having the deletion flag from the external RAM 8 (step S19). When the time counting part 55 counts up three hours (step S15), the time counting part 55 stops the counting of the lapse time after the power is turned off (step S16). The fourth memory control part 64 sets a deletion flag for the non-related program information having been stored in the external RAM 8 (step S17). When power on instruction is input by the keys 4 after a lapse of three hours, the fifth memory control part 65 confirms the deletion flag and deletes the program-related information having the deletion flag from the external RAM 8. At the same time, the fourth memory control part 65 confirms the deletion flag and deletes the non-related program information having the deletion flag from the external RAM 8 (step S19).

As described above, a deletion flag is set for the program-related information when the power is turned off, and the program-related information is deleted from the external RAM 8 when the power is turned on. Furthermore, the non-program related information is not deleted when the power is turned on before a lapse of three hours. A deletion flag is set for the non-program related information after a lapse of three hours and the non-program related information is deleted from the external RAM 8. Therefore, when the power is turned on within three hours after the power is turned off, it is possible to shorten the time to display the received information. And even if the non-program related information is updated during the while the power is off, it is possible to prevent the before-update information having been stored in the external RAM 8 from remaining in the external RAM 8 without being update.

The Embodiment 1 is the case wherein a deletion flag is set for the non-program related information after a lapse of three hours. However, the time of flag setting time is not limited to three hours. In consideration of the time of one round of the update code, the deletion flag may be set for the non-program related information within a shorter time.

A part from the Embodiment 1 is the case wherein a deletion flag is set for the program-related information when the power is turned off and the program-related information is deleted from the external RAM 8 when the power is turned on. The program-related information may be deleted from the external RAM 8 when the power is turned off.

[Embodiment 2]

An FM multiplex information receiving apparatus in accordance with the Embodiment 2 of the present invention is elucidated below in detail referring to FIGS. 4 and 5.

Figure 4:
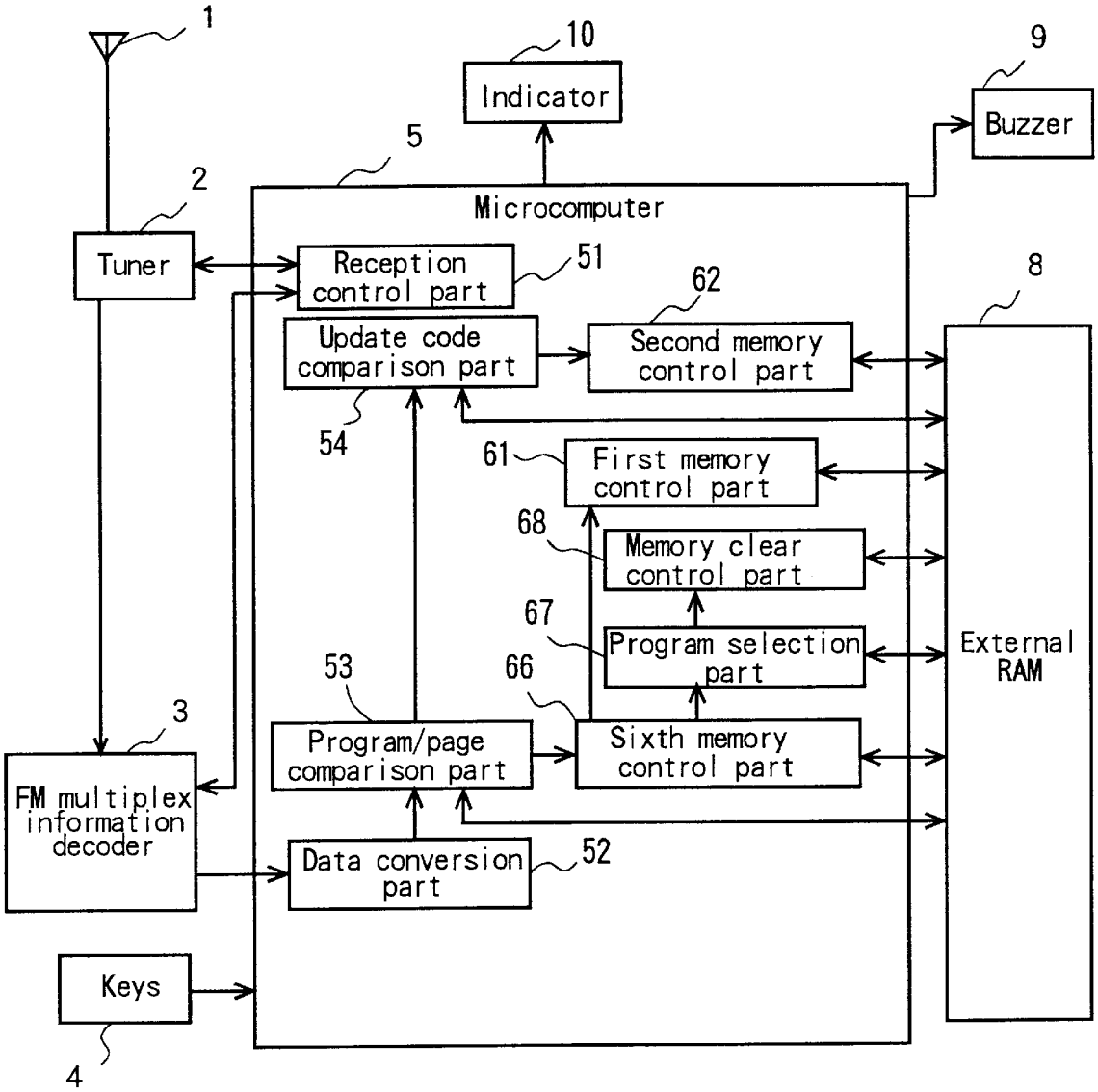
FIG. 4 is a circuit block diagram showing the configuration of another FM multiplex information receiving apparatus in accordance with the present invention.
Figure 5:
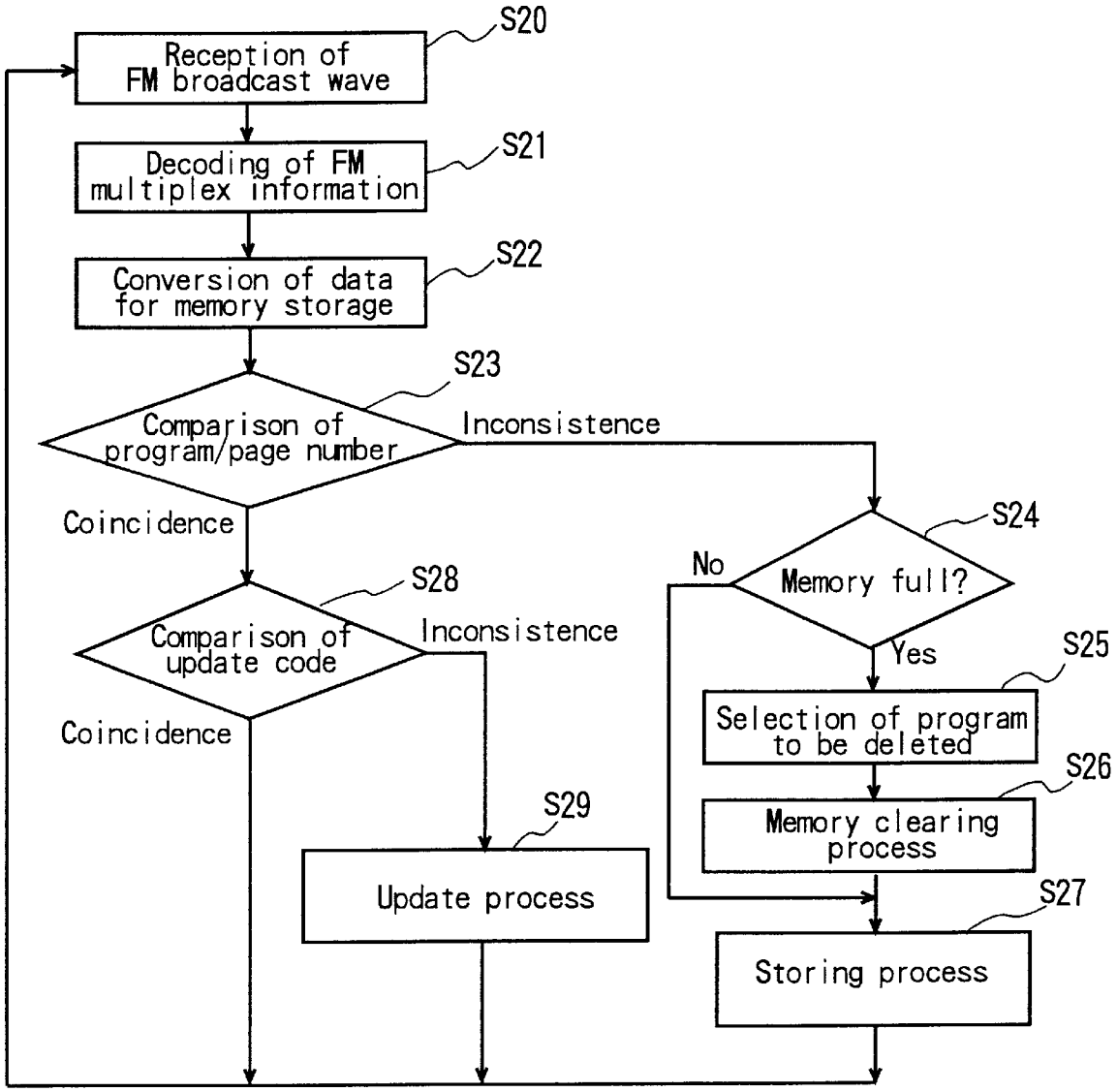
FIG. 5 is a flow chart showing the reception process of the FM multiplex information receiving apparatus shown in FIG. 4.

FIG. 4 shows the FM multiplex information receiving apparatus in accordance with the Embodiment 2. The FM multiplex information receiving apparatus is the same as the FM multiplex information receiving apparatus in accordance with the Embodiment 1 except for the internal configuration of the microcomputer 5. Therefore, only the microcomputer 5 is elucidated below in detail.

The microcomputer 5 comprises a reception control part 51, a data conversion part 52, a program/page comparison part 53, an update code comparison part 54, a first memory control part 61, a second memory control part 62, a sixth memory control part 66, a program selection part 67 and a memory clear control part 68.

The sixth memory control part 66 is for checking whether the external RAM 8 has full space area. The program selection part 67 is selecting data of a program to be deleted from the external RAM 8. There are various methods to select the program to be deleted from the external RAM 8. In one method, program numbers other than the program number of the program being referred to are compared with others and the program having the largest program number is selected. Another method is that program table-of-contents numbers other than the program table-of-contents number of the program being referred to are compared with others and the program having the largest program table-of-contents number is selected. Still other method is that, in case the external RAM 8 does not have full space area, programs which can be deleted are designated beforehand by the user, and the program to be deleted is selected from the designated programs. Further other method is that the program to be deleted from the external RAM 8 is designated by the user. The memory clear control part 68 is for controlling to delete the data of the program selected by the program selection part 67 from the external RAM 8. Regarding other components, the explanations for the Embodiment 1 are applicable, and overlapping descriptions thereof are omitted.

[Reception Process of FM Multiplex Information]

The reception process of the FM multiplex information receiving apparatus is elucidated below in detail referring to the flow chart shown in FIG. 5.

Steps S20 to S22, which are substantially the same as steps S1 to S3 elucidated in detail in the explanation of the Embodiment 1, are executed. The program/page comparison part 53 compares the program number of the program control data and the page number of each page data of the converted data with the program number of the program control data and the page number of each page data of the data having been stored in the external RAM 8, respectively. In case where the comparison result that the data having the same program number of the program control data or the same page number of each page data has not been stored in the external RAM 8, the program/page comparison part 53 determines that new program or new page information which is not stored in the external RAM 8 is received, and the control sequence proceeds to step S24. On the contrary, in case where the comparison result that the data having the same program number of the program control data or the same page number of each page data has not been stored at least in the external RAM 8, the control sequence proceeds to step S28 (step S23). The sixth memory control part 66 checks whether the external RAM 8 has full space area for the FM multiplex information. In case the external RAM 8 does not have full space area for the FM multiplex information, the control sequence proceeds to step S25. In case the external RAM 8 has full space area for the FM multiplex information, the control sequence proceeds to step S27 (step S24). Since the external RAM 8 does not have full space area, the program selection part 67 selects data of a program to be deleted from the external RAM 8 (step S25). The memory clear control part 68 deletes the data of the program selected by the program selection part 67 from the external RAM 8 (step S26). The first memory control part 61 controls to store the data converted by the data conversion part 52 into the external RAM 8 (step S27). In case where the comparison result at step S23 that the date having the same program number or the same page number has been stored in the external RAM 8, steps S28 and S29 are executed, which are the same as steps S6 and S7 detailed in the explanation of the Embodiment 1.

In the update process at step S29, a beep may be issued from the buzzer 9 and a update message may be displays on the display screen of the indicator 10, so as to notify that the received information has been changed.

As described above, in the reception process, the sixth memory control part 66 determines whether the external RAM 8 has the full space area for the FM multiples information. In case there is no full space area left, the data of the program selected by the predetermined method is deleted from the external RAM 8, and the data of the received information is stored into the external RAM 8. Therefore, FM multiplex information can be taken in such a way of efficiently using the external RAM 8.

[Embodiment 3]

An FM multiplex information receiving apparatus in accordance with the Embodiment 3 of the present invention is elucidated below in detail referring to FIG. 6.

Figure 6:
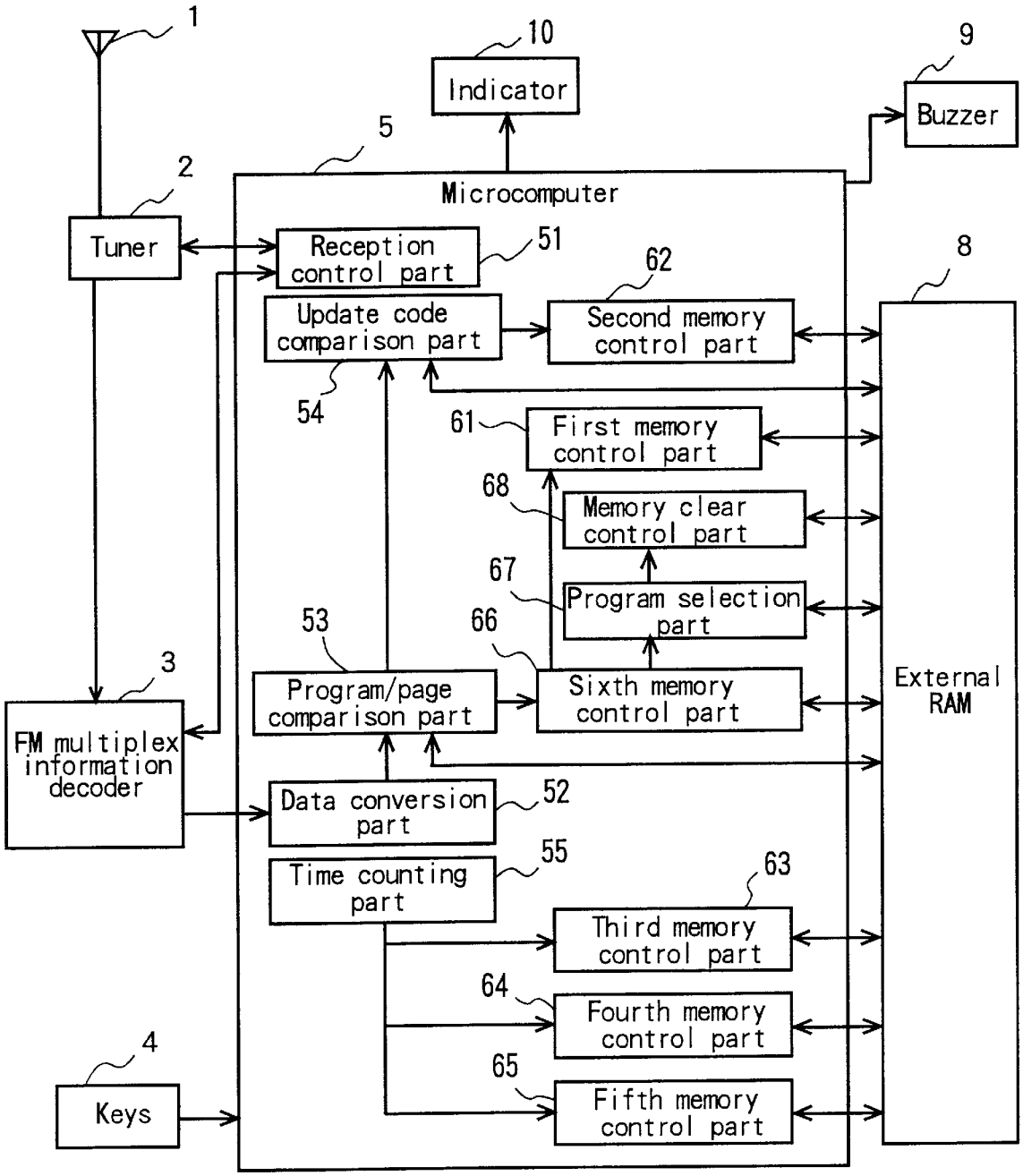
FIG. 6 is a circuit block diagram showing the configuration of still another FM multiplex information receiving apparatus in accordance with the present invention.

FIG. 6 shows the FM multiplex information receiving apparatus in accordance with the Embodiment 3. The Embodiment 3 substantially is the same as the Embodiments 1 and 2 except for the internal configuration of the microcomputer 5.

The microcomputer 5 comprises a reception control part 51, a data conversion part 52, a program/page comparison part 53, an update code comparison part 54, a time counting part 55, a first memory control part 61, a second memory control part 62, a third memory control part 63, a fourth memory control part 64, a fifth memory control part 65, a sixth memory control part 66, a program selection part 67 and a memory clear control part 68. Regarding these components, the explanations for embodiments 1 and 2 are applicable, and overlapping descriptions thereof are omitted.

The reception process of the FM multiplex information receiving apparatus shown in FIG. 6 is substantially the same as the reception process of the FM multiplex information receiving apparatus detailed in the explanation of the Embodiment 2.

The memory control process of the FM multiplex information receiving apparatus shown in FIG. 6 is substantially the same as the reception process of the FM multiplex information receiving apparatus detailed in the explanation of the Embodiment 1. Therefore, unduly overlapping explanations of the reception process and memory control processes are omitted.

In the FM multiplex information receiving apparatus shown in FIG. 6, even when the external RAM 8 does not have full space area, the received information can be stored in the external RAM 8. In case the power is turned on within a lapse of predetermined time length, it is possible to shorten the time to display the received information. Even if the non-program related information is updated during the while the power is off, the before-update information having been stored in the external RAM 8 is assurely replaced with the update information. Therefore, the before-update information is prevented from remaining in the external RAM 8.

We claim:

1. An FM multiplex information receiving apparatus comprising:

means for receiving FM multiplex information including related-program information which is interlocked with audio program being broadcast and non-program related information which is not interlocked with audio program being broadcast, means for, during reception of said FM multiplex information, storing into memory said FM multiplex information that is updated at predetermined interval together with update code, comparing said update code of said FM multiplex information on receiving with said update code of said FM multiplex information having been stored in said memory, and updating said stored FM multiplex information to said FM multiplex information being received in case there is an inconsistence as the result of comparison, means for retaining said non-program related information in said memory for predetermined time length after power off and deleting said program-related information at power off or power on, and means for indicating said non-program related information stored in said memory when the power is turned on again within a lapse of said predetermined time length after the power is turned off.

2. An FM multiplex information receiving apparatus comprising:

means for receiving FM multiplex information including related-program information which is interlocked with audio program being broadcast and non-program related information which is not interlocked with audio program being broadcast, means for, during reception of said FM multiplex information, storing into memory said FM multiplex information that is updated at predetermined interval together with update code, comparing said update code of said FM multiplex information on receiving with said update code of said FM multiplex information having been stored in said memory, and updating said stored FM multiplex information by replacing with said FM multiplex information being received in case there is an inconsistence as the result of comparison, means for determining whether said memory has full space area for said FM multiplex information when said FM multiplex information is stored in said memory, selecting program number of program to be deleted from said FM multiplex information stored in said memory in accordance with a predetermined method in case said memory does not have said full space area, deleting said information of said selected program, and storing newly received FM multiple information.

3. An FM multiplex information receiving apparatus comprising:

receiving means for receiving FM multiplex information including related-program information which is interlocked with audio program being broadcast and non-program related information which is not interlocked with audio program being broadcast, FM multiplex information decoding means for decoding said FM multiplex information received by said receiving means, data conversion means for converting information decoded by said FM multiplex information decoding means, memory means for storing data converted by said data conversion means, program/page comparison means for comparing program number of received program and page number of each page of said received program with program number and page number of each page of program having been stored in said memory means, respectively, when said data is stored in said memory means, first memory control means for controlling to store said data converted by said data conversion means into said memory means with the size of the whole program in case said data having the same program number has not yet been stored in said memory means or with the size of the whole page in case data having the same page number has not yet been stored in said memory means as the result of comparison by said program/page comparison means, update code comparison means for comparing update code of said received program or update code of each page of said received program with update code of program having the same program number or update code of page having the same page number having been stored in said memory means, respectively, in case data having the same program number or the same page number has stored in said memory means as the result of comparison by said program/page comparison means, second memory control means for controlling to execute update process with the size of the program in case said update code of said received program differs from said update code of program having the same program number, or with the size of the page in case said update code of said page of said received program differs from said update code of page having the same page number as the result of comparison by said update code comparison means, third memory control means for controlling to retain said non-program related information stored in said memory means for preset time length after power off, fourth memory control means for controlling to delete said non-program related information from said memory means after a lapse of said preset time length, fifth memory control means for controlling to delete said program-related information at least at power off and at power on, and indication means for indicating said non-program related information in said memory means at power on.

4. An FM multiplex information receiving in accordance with claim 3 comprising:

first step of receiving said FM multiplex information through said receiving means, second step of decoding said FM multiplex information received by said receiving means through said FM multiplex information decoding means, third step of converting information decoded by said FM multiplex information decoding means through said data conversion means, fourth step of comparing said program number of said received program or said page number of each page of said received program with said program number or said page number of each page of said program, respectively, stored in said memory means through said program/page comparison means, fifth step of storing said data with the size of the whole program in case data having the same program number has not yet been stored in said memory means or with the size of the whole page in case data having the same page number has not yet been in said memory means as the result of comparison at said fourth step through said first memory control means, sixth step of comparing said update code of said received program or said update code of each said page of said received program with said update code of program having the same program number or said update code of said page having the same page number having been stored through said update code comparison means in case data having the same program number or page number has been stored in said memory means as the result of comparison at said fourth step, and seventh step of executing update process through said second memory control means with the size of the whole program in case said update code of said received program differs from said update code of program having the same program number or with the size of the whole page in case said update code of said page differs from said update code of page having the same page number as the result of comparison at said sixth step.

5. An FM multiplex information memory controlling in accordance with claim 3 comprising:

first step of deleting said program-related information stored in said memory means at least at power off and at power on through said fifth memory control means, and second step of retaining said non-program related information in said memory means for preset time length after power off through said third memory control means, and deleting said non-program related information after a lapse of said preset time length through said fourth memory control means.

6. An FM multiplex information receiving apparatus in accordance with claim 3, further comprising:

second indication means for visually notifying that said received information has been changed, and notification means for audibly notifying that said received information has been changed.

7. An FM multiplex information receiving apparatus comprising:

receiving means for receiving FM multiplex information including related-program information which is interlocked with audio program being broadcast and non-program related information which is not interlocked with audio program being broadcast, FM multiplex information decoding means for decoding said FM multiplex information received by said receiving means, data conversion means for converting information decoded by said FM multiplex information decoding means, memory means for storing data converted by said data conversion means, program/page comparison means for comparing program number of received program and page number of each page of said received program with program number and page number of each page of program having been stored in said memory means, respectively, when said data is stored in said memory means, first memory control means for controlling to store said data converted by said data conversion means into said memory means with the size of the whole program in case said data having the same program number has not yet been stored in said memory means or with the size of the whole page in case data having the same page number has not yet been stored in said memory means as the result of comparison by said program/page comparison means, update code comparison means for comparing update code of said received program or update code of each page of said received program with update code of program having the same program number or update code of page having the same page number having been stored in said memory means, respectively, in case data having the same program number or the same page number has stored in said memory means as the result of comparison by said program/page comparison means, second memory control means for controlling to execute update process with the size of the program in case said update code of said received program differs from said update code of program having the same program number, or with the size of the page in case said update code of said page of said received program differs from said update code of page having the same page number as the result of comparison by said update code comparison means, sixth memory control means for determining whether said memory means has full space area for said FM multiplex information, program selection means for selecting data of program to be deleted from said memory means in case said memory means does not have said full space area for said FM multiplex information as the result of determination by said sixth memory control means, and memory clear control means for controlling to delete said data of program selected by said program selection means from said memory means.

8. An FM multiplex information receiving in accordance with claim 7 comprising:

first step of receiving said FM multiplex information through said receiving means, second step of decoding said FM multiplex information received by said receiving means through said FM multiplex information decoding means, third step of converting information decoded by said FM multiplex information decoding means through said data conversion means, fourth step of comparing said program number of said received program or said page number of each said page of said received program with said program number or said page number of each page of said program, respectively, stored in said memory means through said program/page comparison means, fifth step of checking whether said memory means has full space area for said FM multiples information through said sixth memory control means in case data having the same program number or the same page number has not yet been as the result of comparison at said fourth step, sixth step of selecting program to be deleted from said memory means through said program selection means in case said memory means does not have said full space area for said FM multiplex information as the result of check at said fifth step, deleting said program from said memory means through said memory control control means, and storing said data through said first memory control means with the size of the whole program in case the same program number has not yet been stored in said memory means or with the size of the whole page in case the same page number has not yet been stored in said memory means, seventh step of storing said data with the size of the whole program or with the size of the whole page in said memory means through said first memory control means in case said memory has said full space area as the result of said check at said fifth step, eighth step of comparing said update code of said received program or said update code of each page of said received program with said update code of said program having the same program number or said update code of said page having the same page number having been stored through said update code comparison means in case data having the same program number or the same page number has been stored in said memory means as the result of comparison at said fourth step, and ninth step of executing update process through said second memory control means with the size of the whole program in case said update code of said received program differs from said update code of program having the same program number or with the size of the whole page in case said update code of said page differs from said update code of page having the same page number as the result of comparison at said eighth step.

9. An FM multiplex information receiving apparatus in accordance with claim 7, further comprising:

second indication means for visually notifying that said received information has been changed, and notification means for audibly notifying that said received information has been changed.

* * * * *